US008267022B1

(12) United States Patent
Saucedo

(10) Patent No.: US 8,267,022 B1
(45) Date of Patent: Sep. 18, 2012

(54) TEXTILE SEWING MACHINE WITH ARCUATE ARTICLE-SUPPORTING MACHINE BED

(75) Inventor: Kent D. Saucedo, Mesa, AZ (US)

(73) Assignee: Armorworks Enterprises, LLC, Chandler, AZ (US)

( * ) Notice: Subject to any disclaimer, the term of this patent is extended or adjusted under 35 U.S.C. 154(b) by 296 days.

(21) Appl. No.: 12/799,198

(22) Filed: Apr. 20, 2010

Related U.S. Application Data

(60) Provisional application No. 61/214,114, filed on Apr. 20, 2009.

(51) Int. Cl.
*D05B 23/00* (2006.01)

(52) U.S. Cl. ..... 112/2

(58) Field of Classification Search ..... 112/2, 293, 112/294, 295, 296, 297, 298, 274, 275, 285, 112/286, 166, 291, 475.01
See application file for complete search history.

(56) References Cited

U.S. PATENT DOCUMENTS

| | | | | |
|---|---|---|---|---|
| 1,934,343 | A * | 11/1933 | Coleman | 112/178 |
| 3,750,602 | A * | 8/1973 | Ottich | 112/475.09 |
| 4,044,698 | A * | 8/1977 | Conner, Jr. | 112/470.07 |
| 4,665,844 | A * | 5/1987 | Shibata | 112/103 |
| 5,383,410 | A * | 1/1995 | Mukai et al. | 112/63 |
| 5,417,173 | A * | 5/1995 | Mitsuji | 112/475.01 |
| 6,293,212 | B1 * | 9/2001 | Ebata et al. | 112/103 |
| 7,493,866 | B2 * | 2/2009 | Fukao | 112/254 |

* cited by examiner

*Primary Examiner* — Tejash Patel
(74) *Attorney, Agent, or Firm* — Schwartz Law Firm, P.C.

(57) ABSTRACT

A generally barrel-shaped machine bed is designed for a textile sewing machine. The sewing machine is adapted for stitching together with thread multiple overlying plies of flexible ballistic fabric. The machine bed defines a substantially semi-cylindrical work surface, such that the stitched ballistic fabric substantially conforms to a curved shape of the work surface and substantially retains the curved shape when sewn.

17 Claims, 5 Drawing Sheets

Fig. 6
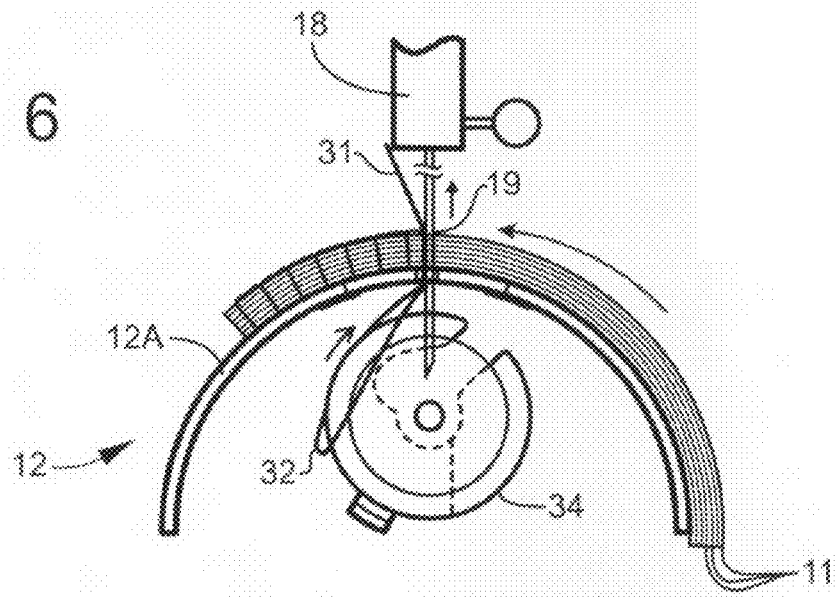
Fig. 7
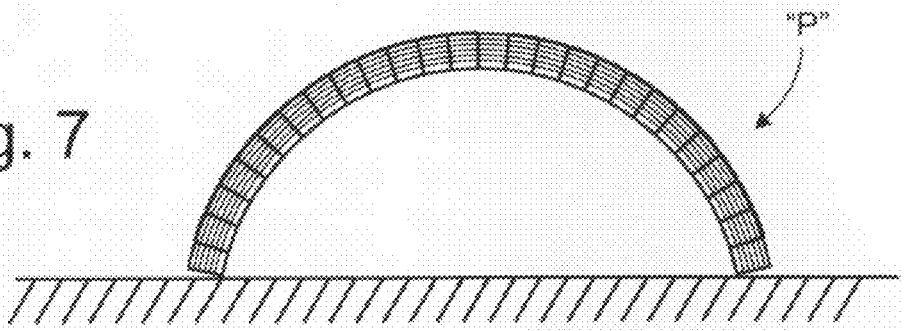
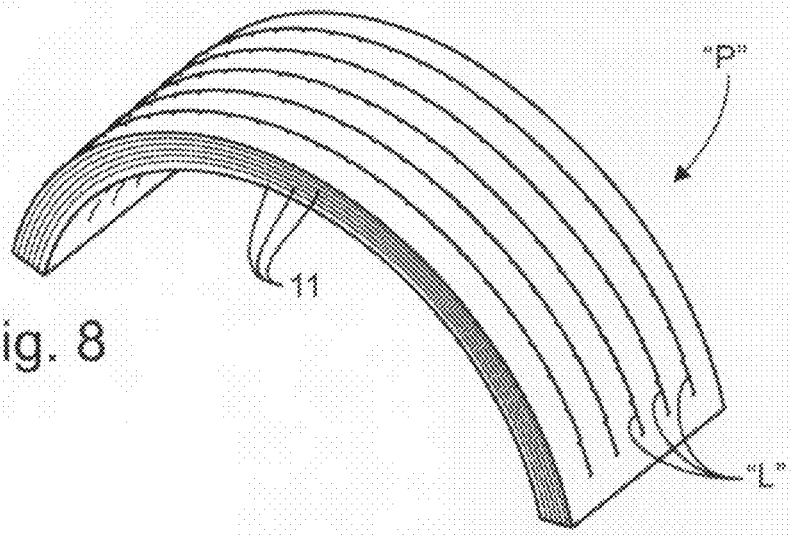
Fig. 8

TEXTILE SEWING MACHINE WITH ARCUATE ARTICLE-SUPPORTING MACHINE BED

TECHNICAL FIELD AND BACKGROUND

The present disclosure relates broadly to a textile sewing machine with an arcuate article-support bed. In one exemplary implementation, the textile machine may be used for manufacturing multilayered contoured ballistic panels or inserts which have inherent arcuate shape retention. For example, the present machine may be used to sew ballistic articles designed to at least partially surround the torso, chest, leg, arm, neck or shoulder of the wearer. The present machine may also be used to assemble any other sewn article intended to at least partially surround underlying or overlying curved structures or substrates.

SUMMARY OF EXEMPLARY EMBODIMENTS

Various exemplary embodiments of the present invention are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a generally barrel-shaped machine bed for a textile sewing machine. The sewing machine is adapted for stitching together with thread multiple overlying plies of ballistic fabric. The machine bed defines a substantially semi-cylindrical work surface, such that the stitched ballistic fabric substantially conforms to the curved shape of the work surface and retains this curved shape when sewn. The exemplary machine bed may comprise an integrally-formed one piece unit formed of metal.

According to another exemplary embodiment, an arcuate throat plate (or "needle plate") is received within an opening defined by the work surface of the machine bed.

According to another exemplary embodiment, an arcuate and transparent insert resides substantially flush with the work surface, and defines a maintenance window for viewing a bobbin spool holder of the sewing machine.

According to another exemplary embodiment, a circumferential perimeter of the work surface measures approximately between 20-30 inches.

According to another exemplary embodiment, a length of the work surface measures approximately between 2-4 feet.

According to another exemplary embodiment, a radius of the work surface measures approximately between 6-10 inches.

In another exemplary embodiment, the present disclosure comprises a textile sewing machine adapted for stitching together with thread multiple overlying plies of flexible ballistic fabric. The sewing machine includes a generally barrel-shaped machine bed defining a substantially semi-cylindrical work surface for carrying the overlying plies of ballistic fabric to be sewn together. A sewing head is disposed above the work surface and comprising a reciprocating needle chuck. An elongated rigid needle is attached to the reciprocating needle chuck, and is adapted for carrying a top needle thread. A bobbin holds a bottom thread. A drive mechanism actuates the reciprocating needle chuck, whereby the rigid needle carries the needle thread downwardly and through the overlying plies of ballistic fabric to be looped with the bottom thread carried by the bobbin.

According to another exemplary embodiment, the drive mechanism comprises an electric motor.

In yet another exemplary embodiment, the present disclosure comprises a method for forming a curved multi-ply flexible ballistic fabric. The method includes stacking multiple plies of flexible ballistic fabric. Feeding the stacked fabric plies through a sewing machine comprising a generally barrel-shaped machine bed. The machine bed defines a substantially semi-cylindrical work surface. From a top side of the curved ballistic fabric, each of the stacked fabric plies is penetrated with a reciprocating sewing needle carrying a top needle thread. At each pass of the reciprocating sewing needle, the top needle thread is looped with a bottom thread supplied by a bobbin on a bottom side of the curved ballistic fabric.

BRIEF DESCRIPTION OF THE DRAWINGS/PHOTOGRAPHS

The description of exemplary embodiments proceeds in conjunction with the following drawings/photographs, in which.

Figure 4:
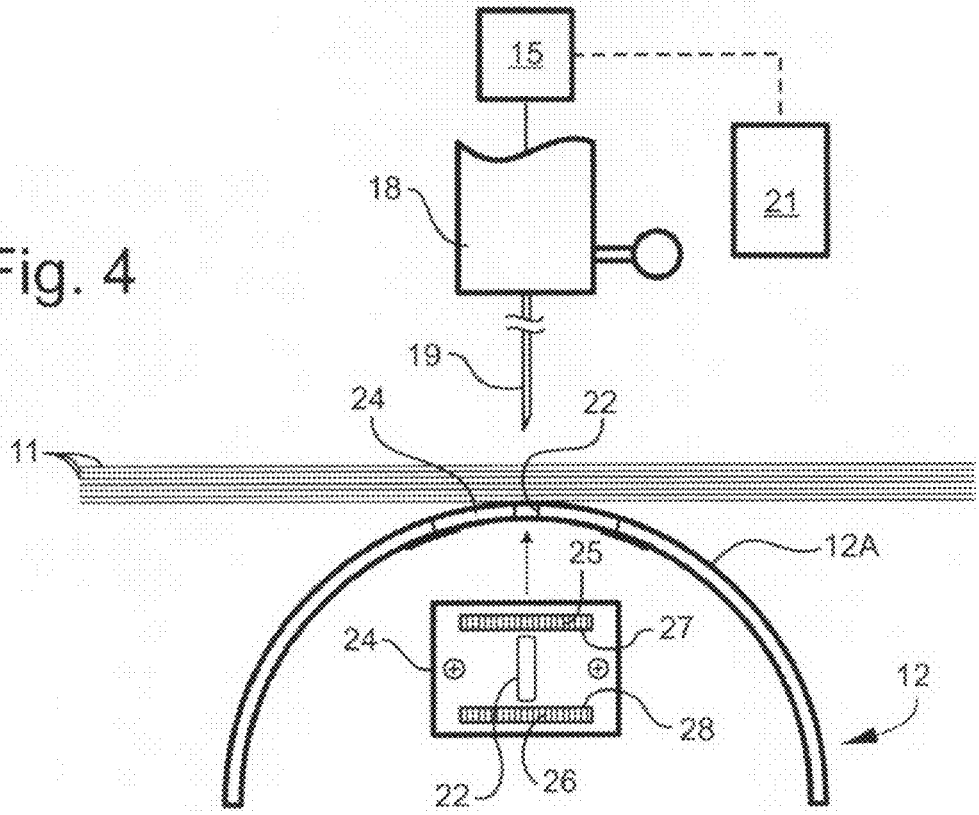
Figure 5:
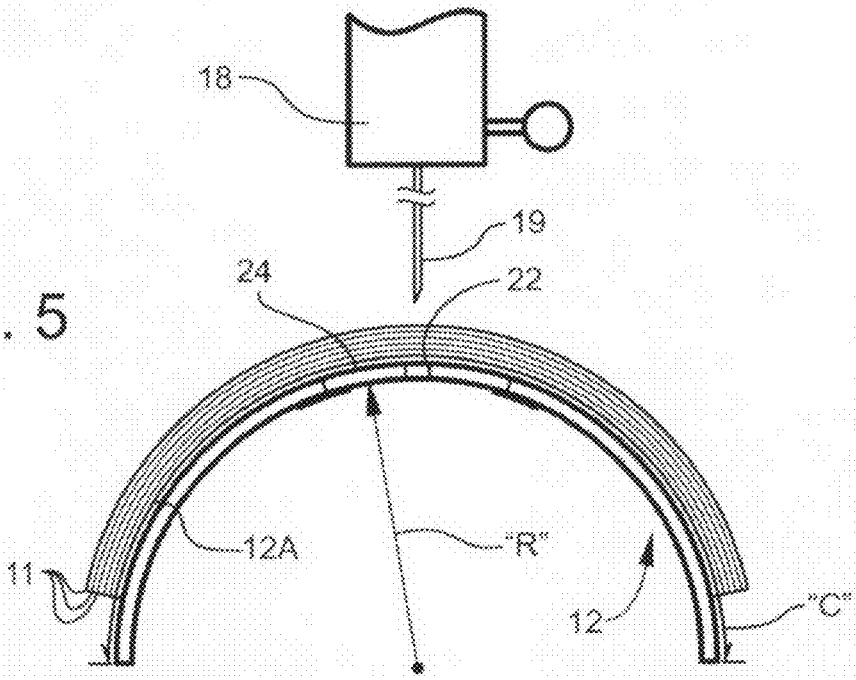

FIGS. 4, 5, and 6 are various schematic views illustrating components of the exemplary textile sewing machine; and FIGS. 7 and 8 show a finished ballistic fabric panel constructed using the exemplary textile sewing machine.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof.

Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
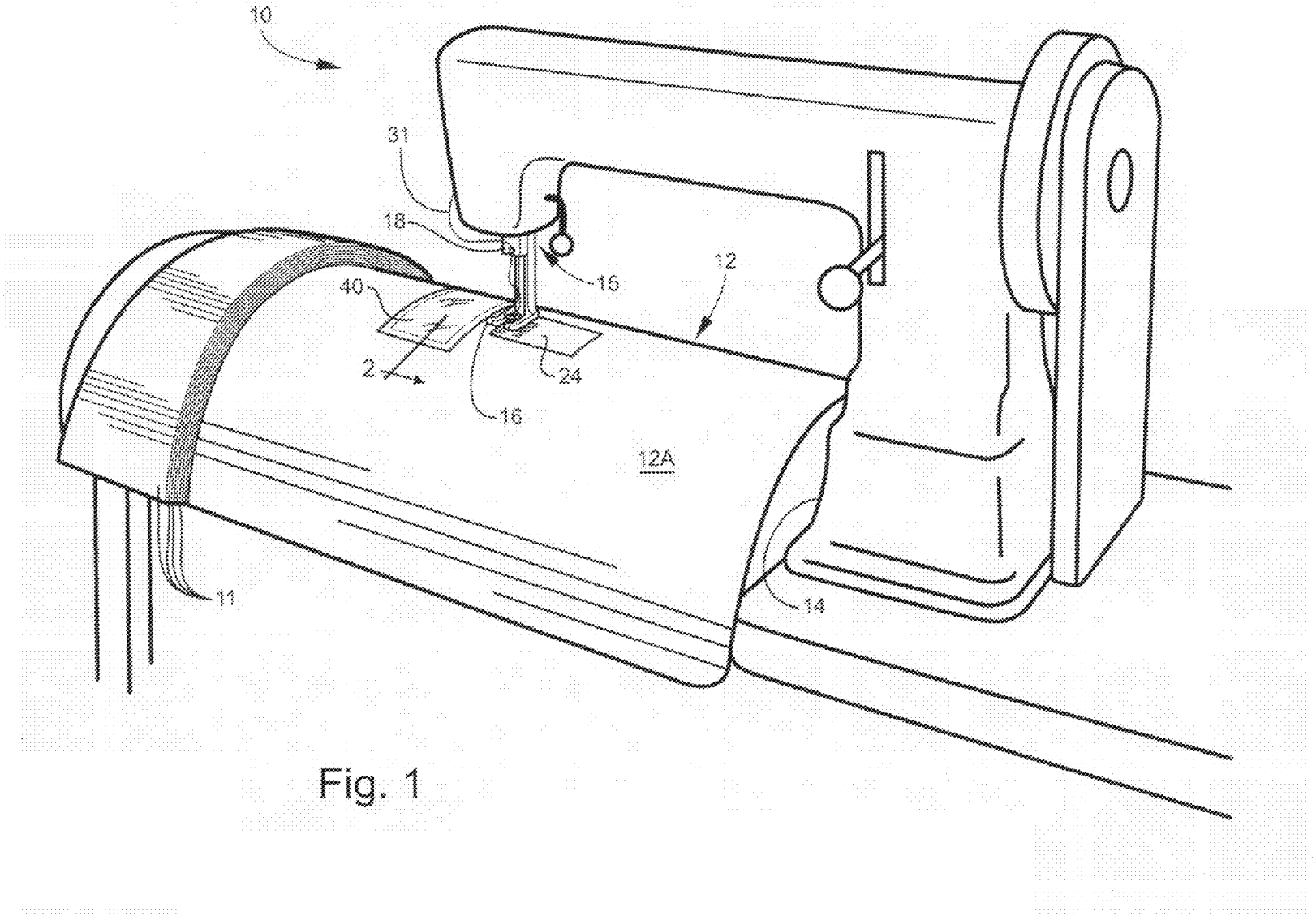
FIG. 1 is a perspective view of a textile sewing machine according to one exemplary embodiment of the present disclosure.

Referring now specifically to the drawings, a textile sewing machine according to one exemplary embodiment of the present invention is illustrated in FIG. 1, and shown generally at reference numeral 10. The exemplary sewing machine 10 is especially applicable for stitching together with thread multiple overlying plies 11 of flexible ballistic fabric to form a substantially curved ballistic panel "P" (FIGS. 7 and 8). The sewing machine 10 may comprise a unison-feed, one-needle, lockstitch machine with a large shuttle-hook for extra heavy-weight materials, and having a maximum sewing speed of 800 rpm and a maximum stitch length of 11 mm.

Each ply 11 of ballistic fabric may incorporate bundled high performance continuous fibers, such as S-glass composed of silica (SiO2), alumina (Al2O3), and magnesia (MgO); aramid fibers, such as commercially-known Twaron®, Technora®, and DuPont's Kevlar®29, Kevlar® 49, Kevlar® 129, and Kelvar® KM2; high molecular weight polyethylene (HMWPE), such as commercially-known Spectra® and Dyneema®; polybenzobisoxazole (PBO) fibers, such as commercially-known Zylon®; and polypyridobisimidazole (PIPD), such as commercially-known M5®. These fibers have high tensile strength, elastic modulus, and strain to failure. For example, such fibers may have a tensile strength greater than about 2000 MPa and an elastic modulus greater than about 60 GPa. The unidirectional fiber plies may be rotated 90° (or other angle) with respect to adjacent layers to create a cross-ply fabric. The exemplary flexible ballistic fabric to be sewn comprises between 25-30 cross-plied (e.g., 0°-90°) layers of unidirectionally-oriented high-performance continuous fibers.

Figure 3:
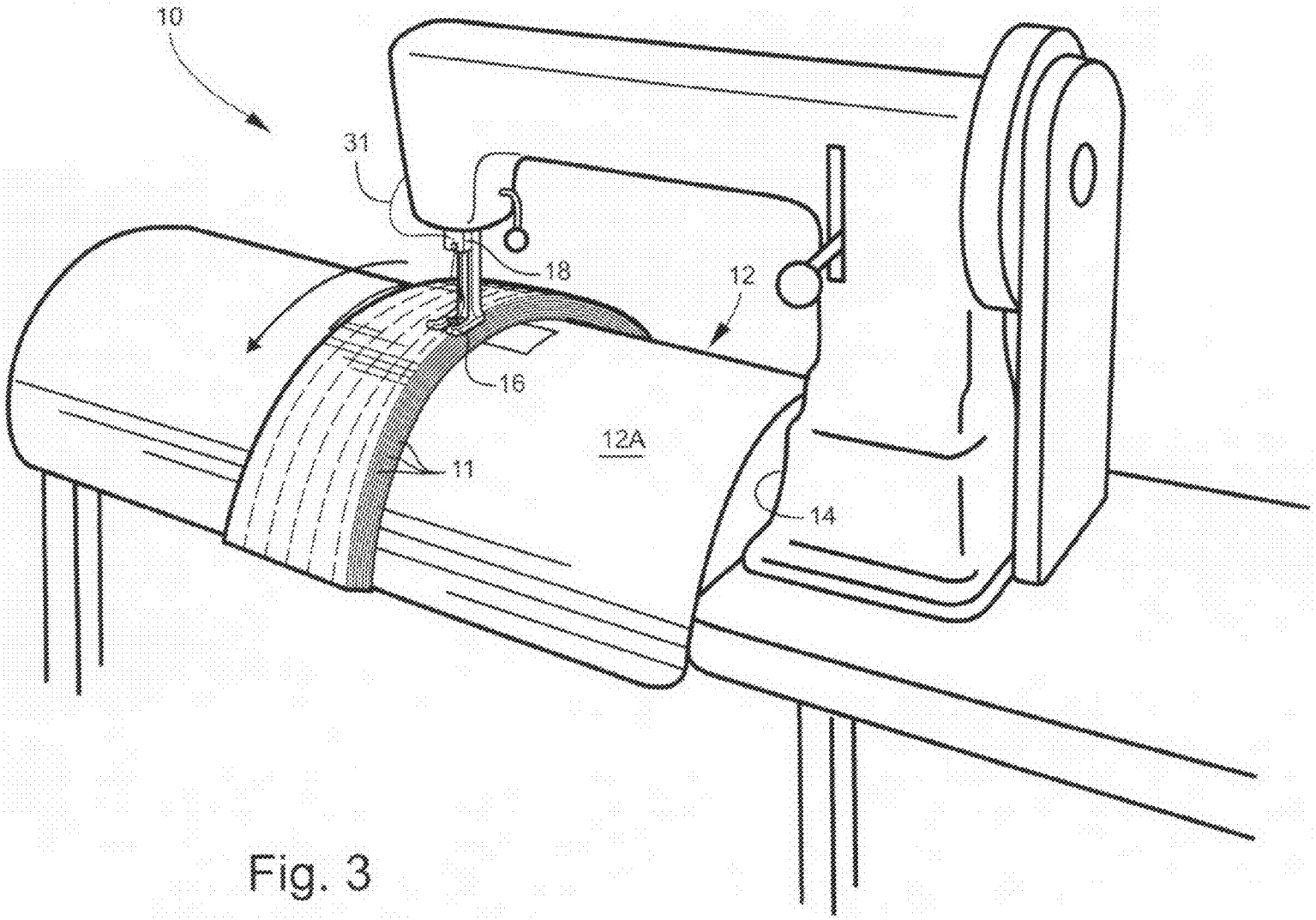
FIG. 3 is a further perspective view of the exemplary textile sewing machine.

As best shown in FIGS. 1 and 3, the exemplary sewing machine 10 has an outwardly-extending and generally barrel-shaped continuous metal machine bed 12. In one exemplary embodiment, the machine bed 12 extends outwardly approximately between 2-4 feet from a base 14 of the sewing machine 10, and defines a substantially semi-cylindrical (or "uniformly curved") work surface 12A designed for carrying the flexible overlying plies 11 of ballistic fabric to be sewn together. The work surface 12A has a circumferential perimeter "C" (See FIG. 5) measuring approximately between 20-30 inches, and a radius "R" measuring approximately between 6-10 inches. The sewing machine 10 incorporates a standard sewing head 15 located above the work surface 12A, and comprising a presser foot 16 and reciprocating needle chuck 18. The needle chuck 18 holds a replaceable elongated sewing needle 19.

As shown (schematically) in FIG. 4, a standard electronic sewing motor 21 is operatively connected to the sewing head 15, and cooperates with known drive elements to reciprocate the needle chuck 18 and attached sewing needle 19. The sewing needle 19 penetrates the stacked fabric plies 11, as described further below, and passes through a needle opening 22 formed with an arcuate throat plate 24. The throat plate 24 resides substantially flush with the arcuate work surface 12A of the machine bed 12. The needle opening 22 of the throat plate 24 is located immediately below the needle chuck 18, and is vertically aligned with the presser foot 16 (FIGS. 1 and 3). In the exemplary sewing machine 10, the presser foot 16 may have a lifting range of 20 mm or more. Additionally, the sewing machine 10 may include spaced feed dogs 25, 26 which periodically lift and move through side openings 27, 28 in the arcuate throat plate 24 to engage and move the stacked fabric plies 11 downstream from the reciprocating sewing needle 19. The electric motor 21 may be controlled in a conventional manner using, for example, an operator footpad (not shown).

Referring again to FIGS. 1 and 2, the sewing machine 10 may utilize separate top and bottom threads 31, 32 to form a lockstitch—the top thread 31 being passed through the sewing needle 19 and the bottom thread 32 coming from a bobbin 34 (or "shuttle"—FIG. 6) located in a bobbin case beneath the work surface 12A of the machine bed 12. As is commonly known in the art, each thread 31, 32 stays on the same side of the material being sewn, interlacing with the other thread at each needle hole.

Figure 2:
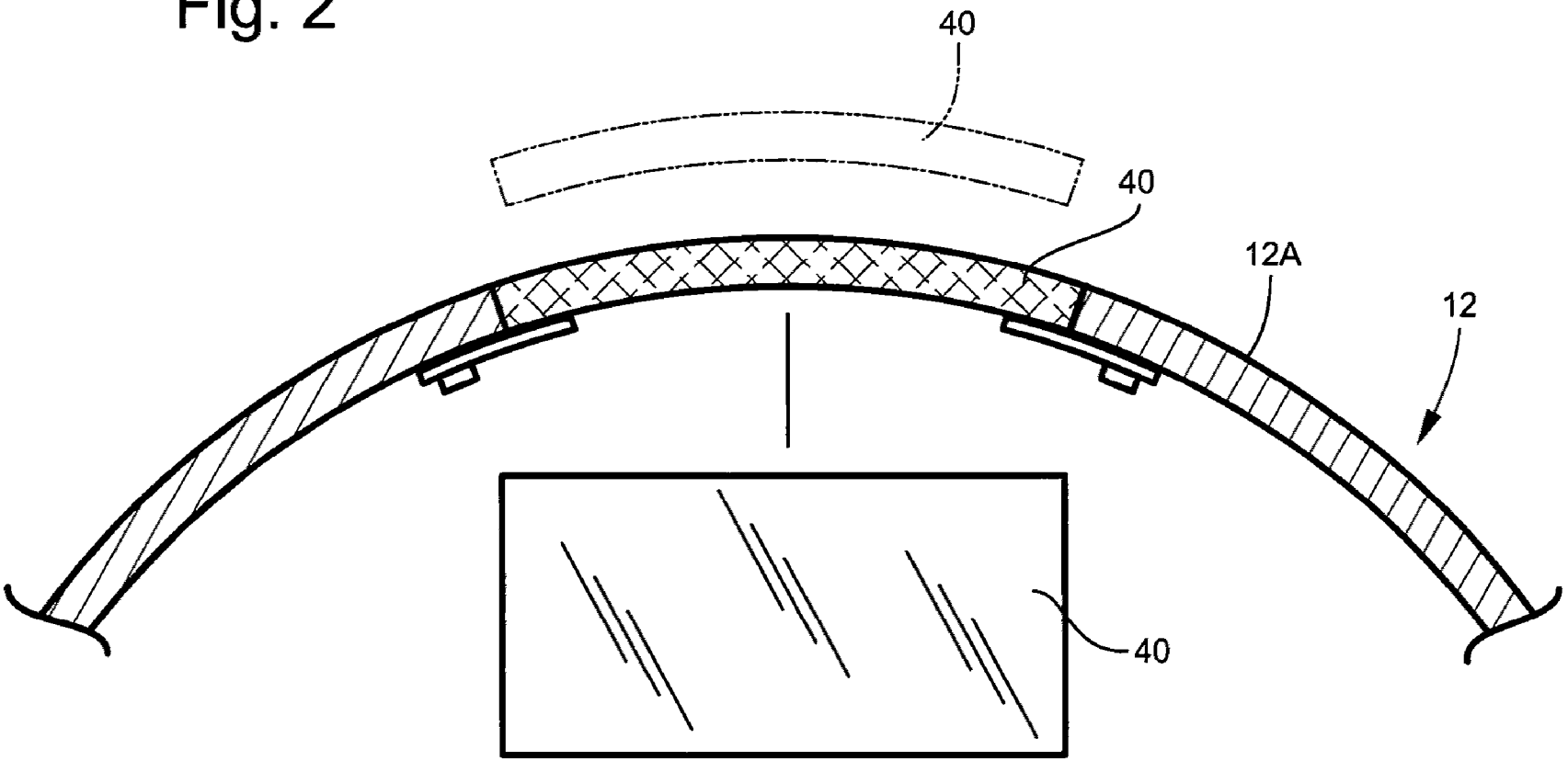
FIG. 2 is a fragmentary cross-sectional view of the curved working surface of the machine base.

During sewing operation, both ends of thread 31, 32 must be periodically replaced. The top thread is generally carried by a spool holder located on or proximate the sewing head 15 above the work surface 12A. As indicated above, the bobbin 34 carrying the bottom thread 32 is located in a bobbin case beneath the work surface 12A of the machine bed 12. To facilitate replacement of the bottom thread 32, the machine bed 12 may incorporate an arcuate and transparent insert 40 substantially flush with the work surface 12A, as best shown in FIG. 2, and defining a maintenance window for viewing the bobbin 34 (and spool holder).

Referring to FIGS. 4, 5, and 6, the exemplary ballistic fabric panel "P" is constructed by stacking multiple flexible plies 11 on the bed 12 of sewing machine 10 such that the fabric plies 11 substantially conform the curved shape of the working surface 12A. During operation of the sewing machine 10, the rigid needle 19 carries the top needle thread 31 downwardly and through the overlying plies 11 of ballistic fabric, as shown in FIG. 6, to be looped with the bottom thread 32 carried by the bobbin 34. As the stacked plies 11 are sewn and moved downstream (away from the operator) along the curved work surface 12A of the machine bed 12, the spaced longitudinal lines of stitches "L" create an inherent contour in the resulting ballistic fabric panel "P". The stacked fabric plies 11 substantially conform to the curved shape of the work surface 12A, and substantially retain this curved shape when sewn. FIGS. 7 and 8 illustrate the finished ballistic fabric panel "P" suitable for incorporating into ballistic body armor designed to surround (at least partially) the torso, chest, leg, arm, neck or shoulder of the wearer. The exemplary ballistic panels may have other applications in vehicle armor, protective shields, and the like.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under §112, 6th paragraph is not intended. Additionally, it is not intended that the scope of patent protection afforded the present invention be defined by reading into any claim a limitation found herein that does not explicitly appear in the claim itself.

What is claimed:

1. A generally barrel-shaped machine bed for a textile sewing machine adapted for stitching together with thread multiple overlying plies of flexible ballistic fabric, said machine bed defining a substantially semi-cylindrical work surface, and comprising an arcuate throat plate received within an opening defined by said work surface, whereby the flexible ballistic fabric substantially conforms to a curved shape of the work surface and substantially retains the curved shape when sewn.

2. A machine bed for a textile sewing machine according to claim 1, and comprising an arcuate and transparent insert substantially flush with said work surface, and defining a maintenance window for viewing a bobbin spool holder of the sewing machine.

3. A machine bed for a textile sewing machine according to claim 1, wherein a circumferential perimeter of the work surface of said machine bed measures approximately between 20-30 inches.

4. A machine bed for a textile sewing machine according to claim 3, wherein a length of the work surface of said machine bed measures approximately between 2-4 feet.

5. A machine bed for a textile sewing machine according to claim 4, wherein a radius of the work surface of said machine bed measures approximately between 6-10 inches.

6. A textile sewing machine adapted for stitching together with thread multiple overlying plies of flexible ballistic fabric, said sewing machine comprising:

a generally barrel-shaped machine bed defining a substantially semi-cylindrical work surface;

a sewing head disposed above said work surface and comprising a reciprocating needle chuck;

an elongated rigid needle attached to said reciprocating needle chuck, and adapted for carrying a top needle thread;

a bobbin for holding a bottom thread; and a drive mechanism for actuating the reciprocating needle chuck, whereby said rigid needle carries the needle thread downwardly and through the overlying plies of ballistic fabric to be looped with the bottom thread carried by said bobbin, such that said ballistic fabric substantially conforms to a curved shape of the work surface and substantially retains the curved shape when sewn.

7. A textile sewing machine according to claim 6, and comprising an arcuate throat plate received within an opening defined by said work surface.

8. A textile sewing machine according to claim 6, and comprising an arcuate and transparent insert substantially flush with said work surface, and defining a maintenance window for viewing said bobbin when replacing the bottom thread.

9. A textile sewing machine according to claim 6, wherein said drive mechanism comprises an electric motor.

10. A textile sewing machine according to claim 6, wherein a circumferential perimeter of the work surface of said machine bed measures approximately between 20-30 inches.

11. A textile sewing machine according to claim 10, wherein a length of the work surface of said machine bed measures approximately between 2-4 feet.

12. A textile sewing machine according to claim 11, wherein a radius of the work surface of said machine bed measures approximately between 6-10 inches.

13. A method for forming a curved multi-ply flexible ballistic fabric panel, said method comprising:

stacking multiple plies of ballistic fabric;

feeding the stacked fabric plies through a sewing machine comprising a generally barrel-shaped machine bed, the machine bed defining a substantially semi-cylindrical work surface;

from a top side of the curved ballistic fabric, penetrating each of the stacked fabric plies with a reciprocating sewing needle carrying a top needle thread; and at each pass of the reciprocating sewing needle, looping the top needle thread with a bottom thread supplied by a bobbin on a bottom side of the curved ballistic fabric, whereby the flexible ballistic fabric substantially conforms to a curved shape of the work surface and substantially retains the curved shape when sewn.

14. A generally barrel-shaped machine bed for a textile sewing machine adapted for stitching together with thread multiple overlying plies of flexible ballistic fabric, said machine bed defining a substantially semi-cylindrical work surface, and comprising an arcuate and transparent insert substantially flush with said work surface, and said insert defining a maintenance window for viewing a bobbin spool holder of the sewing machine, whereby the flexible ballistic fabric substantially conforms to a curved shape of the work surface and substantially retains the curved shape when sewn.

15. A machine bed for a textile sewing machine according to claim 14, wherein a circumferential perimeter of the work surface of said machine bed measures approximately between 20-30 inches.

16. A machine bed for a textile sewing machine according to claim 14, wherein a length of the work surface of said machine bed measures approximately between 2-4 feet.

17. A machine bed for a textile sewing machine according to claim 14, wherein a radius of the work surface of said machine bed measures approximately between 6-10 inches.

* * * * *